US012129845B2

(12) United States Patent
Grimes et al.

(10) Patent No.: US 12,129,845 B2
(45) Date of Patent: Oct. 29, 2024

(54) CONTROLLING A DISCHARGE PRESSURE FROM A PUMP

(71) Applicant: Caterpillar Inc., Peoria, IL (US)

(72) Inventors: Mark Francis Grimes, Cypress, TX (US); Andy Publes, Katy, TX (US); Mark C. Paul, Carmel, IN (US)

(73) Assignee: Caterpillar Inc., Peoria, IL (US)

( * ) Notice: Subject to any disclaimer, the term of this patent is extended or adjusted under 35 U.S.C. 154(b) by 315 days.

(21) Appl. No.: 17/649,525

(22) Filed: Jan. 31, 2022

(65) Prior Publication Data

US 2023/0243351 A1 Aug. 3, 2023

(51) Int. Cl.

| | |
|---|---|
| ***F04B 49/20*** | (2006.01) |
| ***E21B 43/26*** | (2006.01) |
| ***F04B 17/03*** | (2006.01) |
| ***F04B 49/06*** | (2006.01) |

(52) U.S. Cl.

CPC ..... *F04B 49/20* (2013.01); *E21B 43/26* (2013.01); *E21B 43/2607* (2020.05); *F04B 17/03* (2013.01); *F04B 49/065* (2013.01); *F04B 2203/0204* (2013.01); *F04B 2203/0207* (2013.01); *F04B 2203/0209* (2013.01); *F04B 2205/04* (2013.01)

(58) Field of Classification Search

CPC .... F04B 17/03; F04B 47/00; F04B 47/02–10; F04B 2203/0207; F04B 49/065; F04B 49/20; F04B 2203/0204; F04B 2203/0209; E21B 43/26; E21B 43/2607

See application file for complete search history.

(56) References Cited

U.S. PATENT DOCUMENTS

| | | | | |
|---|---|---|---|---|
| 9,650,879 | B2 * | 5/2017 | Broussard | E21B 43/2607 |
| 10,358,035 | B2 * | 7/2019 | Cryer | B60K 1/00 |
| 10,393,108 | B2 * | 8/2019 | Chong | F04B 51/00 |
| 10,648,311 | B2 * | 5/2020 | Oehring | H02P 5/74 |
| 10,753,165 | B1 * | 8/2020 | Fischer | F04B 17/06 |
| 10,851,638 | B2 * | 12/2020 | Payne | E21B 43/2607 |
| 11,149,533 | B1 * | 10/2021 | Yeung | F04B 15/02 |
| 2014/0138079 | A1 * | 5/2014 | Broussard | H02P 23/00 166/66.4 |
| 2017/0114625 | A1 * | 4/2017 | Norris | E21B 43/2607 |
| 2018/0363640 | A1 * | 12/2018 | Kajita | G05B 19/042 |
| 2021/0040830 | A1 * | 2/2021 | Mu | F04B 23/04 |
| 2021/0126561 | A1 * | 4/2021 | Shampine | F04B 17/03 |
| 2021/0372394 | A1 * | 12/2021 | Bagulayan | F04B 23/04 |

OTHER PUBLICATIONS

Ronald R. Gould, "A Guide to Matching Electric Motors with Hydraulic Power Units", 2013; https://maintenanceworld.com/2013/06/28/a-guide-to-matching-electric-motors-with-hydraulic-power-units/ (Year: 2013).*

* cited by examiner

*Primary Examiner* — Alexander B Comley

(57) ABSTRACT

In some implementations, a controller may obtain a setting for a maximum discharge pressure associated with a fluid pump that is to be allowed during a hydraulic fracturing operation. The fluid pump may be driven by a motor that is controlled by a variable frequency drive (VFD). The controller may determine a maximum torque for the motor that achieves the maximum discharge pressure. The controller may cause, via the VFD, adjustment to a speed of the motor to maintain a torque of the motor at or below the maximum torque for the motor.

19 Claims, 3 Drawing Sheets

CONTROLLING A DISCHARGE PRESSURE FROM A PUMP

TECHNICAL FIELD

The present disclosure relates generally to hydraulic fracturing systems and, for example, to controlling a discharge pressure from a pump.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

During hydraulic fracturing operations, a hydraulic fracturing system may be pressurized beyond a capability of the system, for example, due to operator error. Over-pressurizing the hydraulic fracturing system may damage the system and/or may result in an uncontrolled shutdown of the system, thereby adversely affecting the hydraulic fracturing operations and potentially damaging the well. Some hydraulic fracturing systems may employ one or more safeguards to handle over-pressurization. For example, a hydraulic fracturing system may include pressure-limiting relief valves (also referred to as pop off valves), actively controlled valves that utilize a pressure transducer and a hydraulically actuated gate valve, and/or an overpressure control that shuts down pumping if a discharge pressure detected by a pressure transducer exceeds a configured limit. However, such safeguards may be installed incorrectly, are error prone, and are susceptible to hardware failure due to aging or damage.

The control system of the present disclosure solves one or more of the problems set forth above and/or other problems in the art.

SUMMARY

In some implementations, a system for hydraulic fracturing includes at least one fluid conduit; a fluid pump in fluid communication with the at least one fluid conduit; a motor configured to drive the fluid pump; a variable frequency drive (VFD) configured to control the motor; and a controller configured to: receive an input that indicates a setting for a maximum discharge pressure associated with the fluid pump that is to be allowed during a hydraulic fracturing operation; determine a maximum torque for the motor, that achieves the maximum discharge pressure, based on a configuration of the fluid pump; detect, during the hydraulic fracturing operation, whether a torque of the motor corresponds to the maximum torque for the motor; and cause, via the VFD and based on detecting that the torque of the motor corresponds to the maximum torque for the motor, adjustment to a speed of the motor to reduce the torque of the motor to at most the maximum torque for the motor.

In some implementations, a method includes obtaining, by a controller, a setting for a maximum discharge pressure associated with a fluid pump that is to be allowed during a hydraulic fracturing operation, the fluid pump being driven by a motor that is controlled by a VFD; determining, by the controller, a maximum torque for the motor that achieves the maximum discharge pressure; and causing, by the controller via the VFD, adjustment to a speed of the motor to maintain a torque of the motor at or below the maximum torque for the motor.

In some implementations, a controller includes one or more memories; and one or more processors configured to: obtain a setting for a maximum discharge pressure associated with a fluid pump that is to be allowed during a hydraulic fracturing operation, the fluid pump being driven by a motor that is controlled by a VFD; determine a maximum torque for the motor that achieves the maximum discharge pressure; and maintain, during the hydraulic fracturing operation and using the VFD, a torque of the motor at or below the maximum torque for the motor.

DETAILED DESCRIPTION

Figure 1:
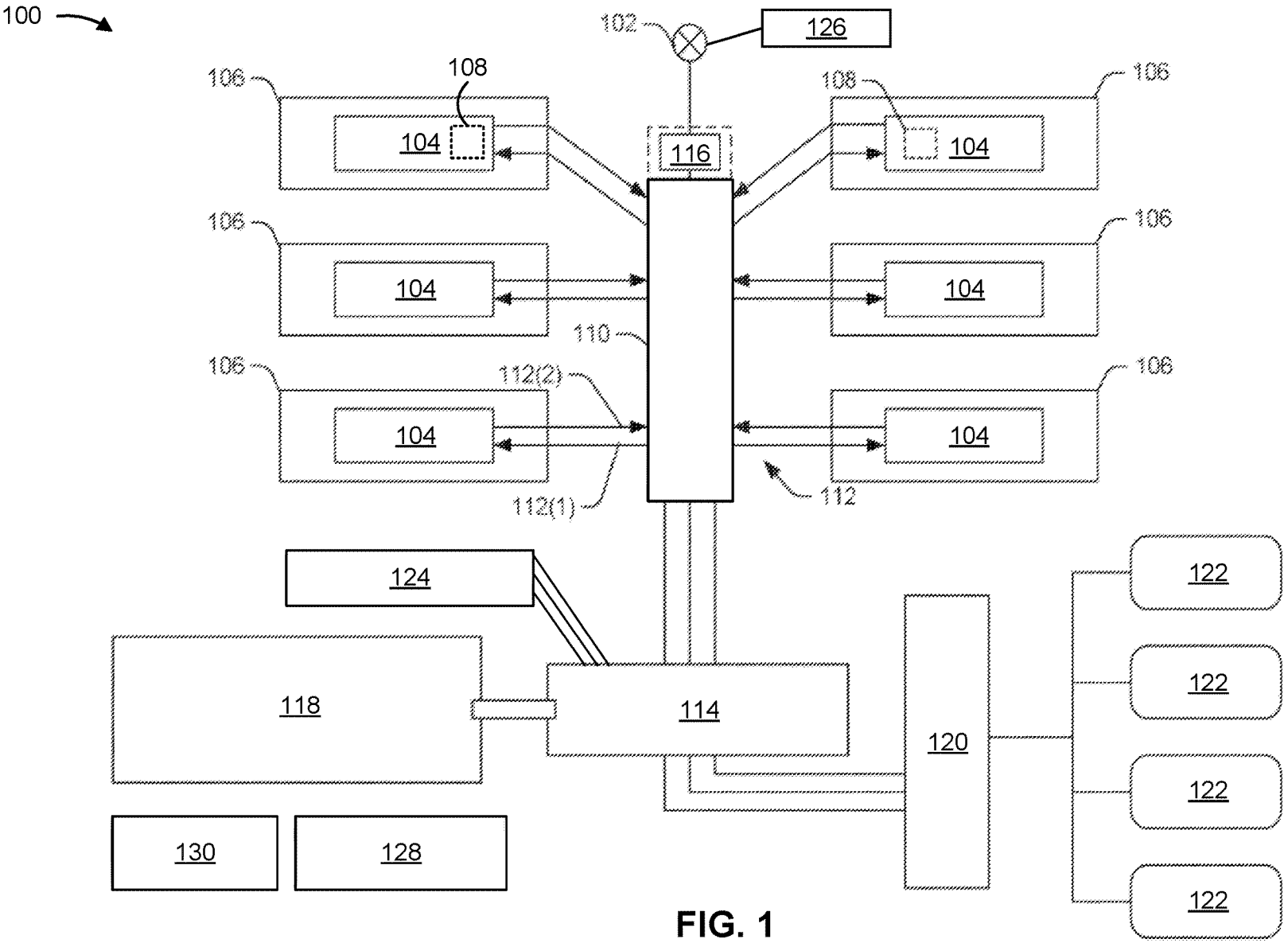
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described previously, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with controlling a discharge pressure from the fluid pumps 108, as described in connection with FIG. 2. In some implementations, the hydraulic fracturing system 100 may include one or more pressure-limiting relief valves and/or actively controlled valves (not shown) for reducing pressure in the hydraulic fracturing system 100 (e.g., as a secondary safeguard to the operations performed by the controller 130).

As indicated above, FIG. 1 is provided as an example. Other examples may differ from what is described with regard to FIG. 1.

Figure 2:
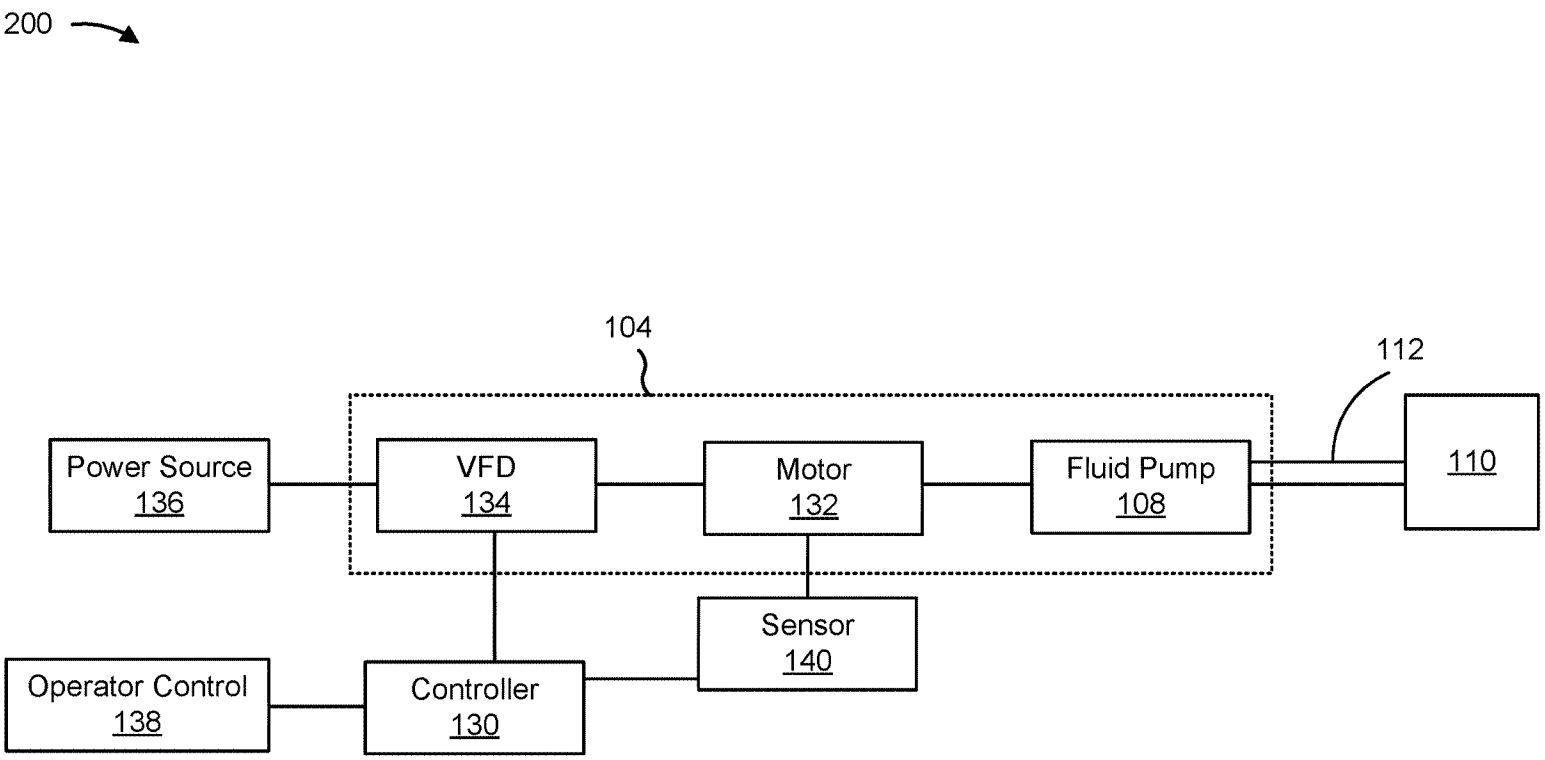
FIG. 2 is a diagram illustrating an example control system.

FIG. 2 is a diagram illustrating an example control system 200. The control system 200 may include one or more components of the hydraulic fracturing system 100, as described herein.

As shown in FIG. 2, the control system 200 includes a pump system 104, and the pump system 104 includes a fluid pump 108, as described herein. The pump system 104 also includes a motor 132 configured to drive (e.g., via a driveshaft) the fluid pump 108. The motor 132 may include an electric motor (e.g., an alternating current (AC) electric motor), such as an induction motor or a switched reluctance motor. In some examples, the fluid pump 108 and the motor 132 may share a housing. The pump system 104 also includes a variable frequency drive (VFD) 134 that controls the motor 132. For example, the VFD 134 includes an electro-mechanical drive system configured to control a speed and/or a torque of the motor 132 by varying an input frequency and/or input voltage to the motor 132. The pump system 104 may receive electrical power from a power source 136. For example, the power source 136 may be a generator, a generator set, a battery, one or more solar panels, an electrical utility grid, an electrical microgrid, or the like.

As shown in FIG. 2, the control system 200 includes at least one fluid conduit 112 and/or the manifold 110, as described herein. The fluid conduit(s) 112 may be in fluid communication with the fluid pump 108. For example, the fluid conduit(s) 112 may fluidly connect the fluid pump 108 and the manifold 110, the manifold 110 and the well 102 (e.g., via the fracturing head 116), or the like. In other words, the fluid conduit(s) 112 may fluidly connect components of the hydraulic fracturing system 100 that are downstream of the manifold 110 and/or the fluid pump 108.

As shown in FIG. 2, the control system 200 includes the controller 130. The controller 130 may be configured to perform operations associated with controlling a discharge pressure from the fluid pump 108, as described herein. The controller 130 may be a component of the VFD 134, or the controller 130 may be a component separate from the VFD 134. For example, the controller 130 may be a pump-specific controller for the pump system 104, or the controller 130 may be a system-wide controller for the hydraulic fracturing system 100.

The controller 130 may obtain a setting for a maximum discharge pressure associated with the fluid pump 108. For example, the setting for the maximum discharge pressure may indicate a maximum discharge pressure for the fluid pump 108 or a maximum discharge pressure of a fluid system that includes the fluid pump 108 and at least one additional fluid pump (e.g., where fluid flows of the fluid pumps are combined at the manifold 110). The maximum discharge pressure may represent a discharge pressure that is adequate, safe, or otherwise prescribed for use during a hydraulic fracturing operation on a particular rock formation. For example, the maximum discharge pressure may be a peak discharge pressure that is to be allowed during a hydraulic fracturing operation (e.g., during operation of the hydraulic fracturing system 100 and/or the control system 200).

In some implementations, the controller 130 may obtain the setting for the maximum discharge pressure from a local or a remote memory or other storage, from another device, or the like. For example, the setting for the maximum discharge pressure may be configured for the controller 130. Additionally, or alternatively, to obtain the setting for the maximum discharge pressure, the controller 130 may receive an input (e.g., an operator input) that indicates the setting for the maximum discharge pressure. For example, the controller 130 may receive the input from an operator control 138 (e.g., a human-machine interface). The operator control 138 may be located at the data monitoring system 128, elsewhere at a hydraulic fracturing site, or remote from the hydraulic fracturing site.

The controller 130 may determine a maximum torque for the motor 132 that achieves the maximum discharge pressure (e.g., achieves the maximum discharge pressure for the fluid pump 108 or for the fluid system that includes the fluid pump 108 and at least one additional fluid pump). The controller 130 may determine the maximum torque for the motor 132, that achieves the maximum discharge pressure, based on a configuration of the pump system 104 (or a configuration of the hydraulic fracturing system 100, the control system 200, or the like). The configuration of the pump system 104 may include a gear ratio of the fluid pump 108 and/or the motor 132, a stroke length of the fluid pump 108, a bore diameter (e.g., a plunger diameter) of the fluid pump 108, and/or a parasitic loss associated with the fluid pump 108, among other examples. In some implementations, the controller 130 may determine the maximum torque for the motor 132, that achieves the maximum discharge pressure, using a look-up table, a torque curve, a physics-based estimation model, an artificial intelligence model (e.g., a machine learning model), or the like (e.g., that is based on the configuration of the pump system 104, an age of the pump system 104, or the like).

The controller 130 may maintain, during the hydraulic fracturing operation and using the VFD 134, a torque of the motor 132 at or below the maximum torque that is determined. In this way, a discharge pressure from the fluid pump 108, from the fluid system, or the like, may be maintained at or below the maximum discharge pressure that is set.

In some implementations, the controller 130 may detect, during a hydraulic fracturing operation (e.g., an operation for pressurizing hydraulic fracturing fluid, an operation for discharging pressurized hydraulic fracturing fluid, or the like), whether the torque of the motor 132 corresponds to (e.g., is equal to, exceeds, or the like) the maximum torque. To detect whether the torque corresponds to the maximum torque, the controller 130 may monitor the torque of the motor 132, and the controller 130 may compare the torque to the maximum torque (e.g., the controller 130 may maintain the torque of the motor 132 at or below the maximum torque based on the comparison). To monitor the torque, the controller 130 may determine an estimated actual torque of the motor 132 and/or be configured to obtain a measurement of the actual torque of the motor 132. The controller 130 may determine the estimated torque of the motor 132 based on a magnetic flux of the motor 132 and/or a current of an armature of the motor 132. The controller 130 may obtain the measurement of the torque of the motor 132 from a sensor 140 (e.g., a torque transducer) configured to detect the torque of the motor 132. The sensor 140 may be located at an output shaft of the motor 132.

The controller 130 may adjust, or cause adjustment to, the speed of the motor 132 based on the maximum torque. That is, the controller 130 may adjust, or cause adjustment to, a speed of the motor 132 (e.g., including control of a rate of change of the speed of the motor 132 for improved stabilization) to maintain the torque of the motor 132 at or below the maximum torque. For example, the controller 130 may cause adjustment to the speed of the motor 132 to reduce the torque of the motor 132 to at most the maximum torque. The controller 130 may cause adjustment to the speed of the motor 132 based on detecting that the torque of the motor corresponds to the maximum torque for the motor. This way, if the torque of the motor 132 is too high (e.g., producing a discharge pressure greater than the maximum discharge pressure), based on the maximum torque that is set, the speed of the motor 132 is adjusted to reduce the torque (e.g., to reduce the discharge pressure).

The controller 130 may cause adjustment to the speed of the motor 132 via the VFD 134 (e.g., by communicating with a motor control processing unit of the VFD 134). For example, the controller 130 may set a torque setting (e.g., a torque target setting or a torque limit setting), in a control mode (e.g., a torque control mode or a speed control mode) for the VFD 134, to the maximum torque. In accordance with the torque setting being set to the maximum torque, the VFD 134 may control the motor 132 by adjusting (e.g., reducing) the speed of the motor 132 to maintain the torque of the motor 132 at or below the maximum torque. In other words, the controller 130 may cause adjustment of the speed of the motor 132 by causing the VFD 134 to vary an input frequency and/or an input voltage to the motor 132 to maintain the torque of the motor 132 at or below the maximum torque. In some implementations, if the speed of the motor 132 is reduced more than necessary to maintain the torque at the maximum torque (e.g., an over-correction is performed), the speed of the motor may be recovered according to acceleration criteria configured for the VFD 134 (e.g., in a settings for a motor control processing unit of the VFD 134).

During the hydraulic fracturing operation, the controller 130 may receive (e.g., via the operator control 138) an operator command to increase a flow rate of the fluid pump 108 to a level that would result in a discharge pressure associated with the fluid pump 108 that exceeds the maximum discharge pressure. Here, the controller 130 may maintain the torque of the motor 132 at or below the maximum torque, as described herein, without regard to the operator command to the contrary. In this way, maintaining the torque of the motor 132 at or below the maximum torque prevents the flow rate from increasing to the level indicated by the operator command.

While the description herein is described in terms of controlling discharge pressure by adjusting the speed of a single motor 132, in some implementations, the controller 130 may cause adjustment of speeds for multiple motors 132 that drive respective fluid pumps 108 (e.g., of respective trailers 106).

As indicated above, FIG. 2 is provided as an example. Other examples may differ from what is described with regard to FIG. 2.

Figure 3:
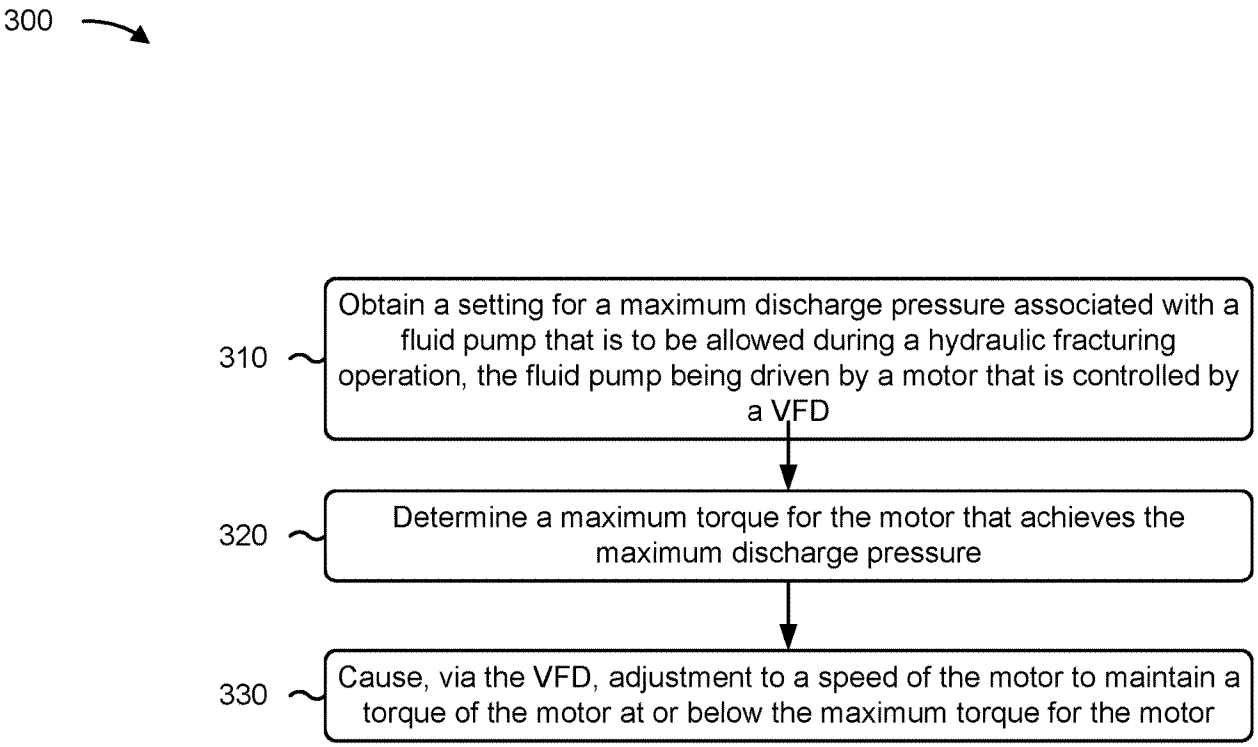
FIG. 3 is a flowchart of an example process relating to controlling a discharge pressure from a pump.

FIG. 3 is a flowchart of an example process 300 associated with controlling a discharge pressure from a pump. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100. Additionally, or alternatively, one or more process blocks of FIG. 3 may be performed by one or more components of a device, such as a processor, a memory, an input component, an output component, and/or communication component.

As shown in FIG. 3, process 300 may include obtaining a setting for a maximum discharge pressure associated with a fluid pump that is to be allowed during a hydraulic fracturing operation, the fluid pump being driven by a motor that is controlled by a VFD (block 310). For example, the controller (e.g., using a processor, a memory, a storage component, a communication component, or the like) may obtain a setting for a maximum discharge pressure associated with a fluid pump that is to be allowed during a hydraulic fracturing operation. Obtaining the setting for the maximum discharge pressure may include receiving an input that indicates the setting for the maximum discharge pressure.

As further shown in FIG. 3, process 300 may include determining a maximum torque for the motor that achieves the maximum discharge pressure (block 320). For example, the controller (e.g., using a processor, a memory, or the like) may determine a maximum torque for the motor that achieves the maximum discharge pressure, as described above. The maximum torque for the motor that achieves the maximum discharge pressure may be determined based on a configuration of the fluid pump that includes one or more of a gear ratio of the fluid pump and/or the motor, a stroke length of the fluid pump, or a bore diameter of the fluid pump.

As further shown in FIG. 3, process 300 may include causing adjustment to a speed of the motor to maintain a torque of the motor at or below the maximum torque for the motor (block 330). For example, the controller (e.g., using a processor, a memory, a communication component, or the like) may cause adjustment to a speed of the motor to maintain a torque of the motor at or below the maximum torque for the motor, as described above. Causing adjustment to the speed of the motor may include causing the VFD to vary at least one of an input frequency or an input voltage to the motor. For example, causing adjustment to the speed of the motor may include setting a torque setting in a control mode for the VFD to the maximum torque for the motor.

Process 300 may include detecting that the torque of the motor corresponds to (e.g., is equal to or exceeds) the maximum torque for the motor. Here, causing adjustment to the speed of the motor reduces the torque of the motor to at most the maximum torque for the motor. Detecting that the torque of the motor exceeds the maximum torque for the motor may include monitoring the torque of the motor, and comparing the torque of the motor to the maximum torque for the motor. Monitor the torque of the motor may include determining an estimated torque of the motor, or obtaining a measurement of the torque of the motor.

Process 300 may include receiving an operator command to increase a flow rate of the fluid pump to a level that would result in a discharge pressure that exceeds the maximum discharge pressure. Here, causing adjustment to the speed of the motor prevents the flow rate from increasing to the level indicated by the operator command.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using motor-driven pumps. For example, the control system may be used with a hydraulic fracturing system that pressurizes hydraulic fracturing fluid using a pump that is driven by a motor that is controlled by a VFD. The control system is useful for preventing over-pressurization of the hydraulic fracturing system, which can lead to damage or an uncontrolled shutdown of the hydraulic fracturing system. In particular, the control system may automatically maintain a discharge pressure of the hydraulic fracturing system at or below a setting for a maximum discharge pressure. The control system may maintain the discharge pressure at or below the maximum discharge pressure by translating the maximum discharge pressure to a maximum torque for the motor, and controlling a speed of the motor, via the VFD, to maintain a torque of the motor at or below the maximum torque.

Thus, the control system provides improved control of the discharge pressure and reduces a likelihood that the hydraulic fracturing system will be over-pressurized. In particular, the control system provides a fast response to a potential over-pressurization event, to effectively prevent the over-pressurization event rather than merely react to the event. Accordingly, the control system may prevent damage to the hydraulic fracturing system, prevent uncontrolled shutdown of the hydraulic fracturing system, improve an uptime of the hydraulic fracturing system, or the like.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A system for hydraulic fracturing, comprising:
at least one fluid conduit;
a fluid pump in fluid communication with the at least one fluid conduit;
a motor configured to drive the fluid pump;
a variable frequency drive (VFD) configured to control the motor; and
a controller configured to:
receive an input that indicates a setting for a maximum discharge pressure associated with the fluid pump that is to be allowed during a hydraulic fracturing operation;
determine a maximum torque for the motor, that achieves the maximum discharge pressure, based on a configuration of the fluid pump;
detect, during the hydraulic fracturing operation, whether a torque of the motor corresponds to the maximum torque for the motor; and
cause, via the VFD, based on detecting that the torque of the motor corresponds to the maximum torque for the motor, and in a manner that maintains a discharge pressure for continued operation of the system for hydraulic fracturing, adjustment to a speed of the motor to reduce the torque of the motor to at most the maximum torque for the motor.

2. The system of claim 1, wherein the controller, to detect whether the torque of the motor corresponds to the maximum torque for the motor, is configured to:
monitor the torque of the motor; and
compare the torque of the motor to the maximum torque for the motor.

3. The system of claim 2, wherein the controller, to monitor the torque of the motor, is configured to:
determine an estimated torque of the motor, or
obtain a measurement of the torque of the motor.

4. The system of claim 1, wherein the controller, to cause adjustment to the speed of the motor, is configured to:
set a torque setting in a control mode for the VFD to the maximum torque for the motor.

5. The system of claim 1, wherein the torque of the motor corresponds to the maximum torque for the motor if the torque is equal to the maximum torque or if the torque exceeds the maximum torque.

6. The system of claim 1, wherein the configuration of the fluid pump includes one or more of:
a gear ratio of the fluid pump,
a stroke length of the fluid pump, or
a bore diameter of the fluid pump.

7. The system of claim 1, wherein at least the fluid pump and the motor are mounted on a hydraulic fracturing trailer.

8. A method, comprising:
obtaining, by a controller, a setting for a maximum discharge pressure associated with a fluid pump that is to be allowed during a hydraulic fracturing operation, the fluid pump being driven by a motor that is controlled by a variable frequency drive (VFD);
determining, by the controller and based on a configuration of the fluid pump, a maximum torque for the motor that achieves the maximum discharge pressure;
detecting, during the hydraulic fracturing operation, whether a torque of the motor corresponds to the maximum torque for the motor; and
causing, by the controller via the VFD, based on detecting that the torque of the motor corresponds to the maximum torque for the motor, and in a manner that maintains a discharge pressure for continued operation of the fluid pump for the hydraulic fracturing operation, adjustment to a speed of the motor to maintain the torque of the motor at or below the maximum torque for the motor.

9. The method of claim 8, wherein obtaining the setting for the maximum discharge pressure comprises:
receiving an input that indicates the setting for the maximum discharge pressure.

10. The method of claim 8, further comprising:
detecting that the torque of the motor exceeds the maximum torque for the motor,
wherein causing adjustment to the speed of the motor reduces the torque of the motor to at most the maximum torque for the motor.

11. The method of claim 10, wherein detecting that the torque of the motor exceeds the maximum torque for the motor comprises:
monitoring the torque of the motor; and
comparing the torque of the motor to the maximum torque for the motor.

12. The method of claim 8, wherein causing adjustment to the speed of the motor comprises:
causing the VFD to vary at least one of an input frequency or an input voltage to the motor.

13. The method of claim 8, further comprising:
receiving an operator command to increase a flow rate of the fluid pump to a level that would result in a discharge pressure that exceeds the maximum discharge pressure,
wherein causing adjustment to the speed of the motor prevents the flow rate from increasing to the level indicated by the operator command.

14. The method of claim 8, wherein the fluid pump is a hydraulic fracturing pump.

15. A controller, comprising:
one or more memories; and
one or more processors configured to:
obtain a setting for a maximum discharge pressure associated with a fluid pump that is to be allowed during a hydraulic fracturing operation,
the fluid pump being driven by a motor that is controlled by a variable frequency drive (VFD);
determine, based on a configuration of the fluid pump, a maximum torque for the motor that achieves the maximum discharge pressure;
detect, during the hydraulic fracturing operation, whether a torque of the motor corresponds to the maximum torque for the motor; and
maintain, during the hydraulic fracturing operation and using the VFD, a torque of the motor at or below the maximum torque for the motor by causing, based on detecting that the torque of the motor corresponds to the maximum torque for the motor, and in a manner that maintains a discharge pressure for continued operation of the fluid pump for the hydraulic fracturing operation, adjustment to a speed of the motor.

16. The controller of claim 15, wherein the configuration of the fluid pump includes one or more of a gear ratio of the fluid pump, a stroke length of the fluid pump, or a bore diameter of the fluid pump.

17. The controller of claim 15, wherein the one or more processors are further configured to:

determine an estimated torque of the motor, or obtain a measurement of the torque of the motor.

18. The controller of claim 17, wherein the torque of the motor is maintained at or below the maximum torque for the motor based on a comparison of the maximum torque with the estimated torque or the measurement of the torque.

19. The controller of claim 15, wherein the one or more processors are further configured to:

receive an operator command to increase a flow rate of the fluid pump to a level that would result in a discharge pressure that exceeds the maximum discharge pressure, and wherein maintaining the torque of the motor at or below the maximum torque for the motor prevents the flow rate from increasing to the level of the operator command.

* * * * *